US008508453B2

(12) United States Patent
Nakayama

(10) Patent No.: US 8,508,453 B2
(45) Date of Patent: Aug. 13, 2013

(54) DISPLAY PANEL DRIVING APPARATUS

(75) Inventor: Akira Nakayama, Chiba (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 608 days.

(21) Appl. No.: 12/533,133

(22) Filed: Jul. 31, 2009

(65) Prior Publication Data

US 2010/0039413 A1 Feb. 18, 2010

(30) Foreign Application Priority Data

Aug. 13, 2008 (JP) ..... 2008-208529

(51) Int. Cl.
*G09G 3/36* (2006.01)

(52) U.S. Cl.
USPC ..... 345/98; 345/100

(58) Field of Classification Search
USPC ..... 345/98, 99, 100, 204, 690
See application file for complete search history.

(56) References Cited

U.S. PATENT DOCUMENTS 5,675,354 A * 10/1997 Katakura et al. ..... 345/97
6,608,642 B1 * 8/2003 Omae ..... 347/237
7,659,878 B2 * 2/2010 Endou et al. ..... 345/100
2003/0169244 A1 * 9/2003 Kurokawa et al. ..... 345/204
2005/0162371 A1 * 7/2005 Morita ..... 345/98
2005/0264548 A1 * 12/2005 Okamura et al. ..... 345/204
2007/0152947 A1 * 7/2007 Tanaka et al. ..... 345/100
2008/0117237 A1 * 5/2008 Saito et al. ..... 345/690

FOREIGN PATENT DOCUMENTS

JP 2005338421 A 12/2005

* cited by examiner

*Primary Examiner* — Chanh Nguyen
*Assistant Examiner* — Pegeman Karimi
(74) *Attorney, Agent, or Firm* — Taft Stettinius & Hollister LLP

(57) ABSTRACT

The present disclosure provides a display panel driving apparatus for driving a display panel including a plurality of display cells, in accordance with an inputted image signal, including, a first latch section that successively reads and holds a pixel data piece for each pixel based on the inputted image signal, a second latch section that successively reads and outputs pixel data pieces every Q pieces (Q is an integer equal to or larger than 2) with a predetermined time difference therebetween in accordance with a load signal, a drive potential generating section that generates a drive potential to drive each of the display cells based on the outputted pixel data pieces, and an output gate section that applies the drive potentials to the respective display cells of the display panel, simultaneously after an elapse of a predetermined time period from a timing of supplying the load signal.

10 Claims, 8 Drawing Sheets

DISPLAY PANEL DRIVING APPARATUS

CROSS-REFERENCE TO RELATED APPLICATIONS

This application claims priority under 35 U.S.C. §119 from Japanese Patent Application No. 2008-208529 filed on Aug. 13, 2008, the disclosure of which is incorporated by reference herein.

RELATED ART

1. Field of the Invention

The present disclosure relates to a display panel driving apparatus for displaying an image based on an inputted image signal, as well as methods of fabricating a display panel driving apparatus.

2. Description of the Related Art

As a display panel, there is, for example, an active matrix type liquid crystal display panel. In such panel, m scan lines (m: an integer equal to or larger than 2) that extends in a horizontal direction of a two-dimensional screen, and n source lines (n: an integer equal to or larger than 2) that extends in a vertical direction of the two-dimensional screen, are arranged to intersect with each other. Further, a pixel including an electrode and a transistor for applying a potential on the source line to the electrode are formed at an intersecting section of the source line and the scan line. Accordingly, n transistors each including the pixel respectively, are formed on one scan line.

Further, the liquid display panel is mounted with a source driver. The source driver generates image signals for each scan lines (n pieces) respectively, which corresponds to the brightness level of each pixel indicated by an inputted image-signal, and respectively applies the image signals to the source lines (refer to, for example, JP-A No. 2005-338421). The source driver is mounted with two stages of latches that holds image data each indicating a brightness value for one scan line (n pieces) based on the inputted image signal (refer to, for example, JP-A No. 2005-338421, a first latch section 110 and a second latch section 120 of FIG. 1). The first latch section 110 reads the inputted image data in series, and transmits the inputted image data to the second latch section 120 each time when finishing reading image data for one scan line. The second latch section 120 simultaneously reads image data for one scan line. Then, the second latch section 120 transmits the image data to a decoder 160 that converts the image data into n pieces of image signals Y1 through Yn having analog potential values.

At the second latch section 120, when simultaneously reading image data for one scan line, a large number of bit inversions are generated for one scan line from data read in the previous time, and large current flows instantaneously. In such a case, by the flow of the instantaneous large current, spike noises are generated in a power source line or in some signal lines, and therefore EMI (electro magnetic interference) occurs.

INTRODUCTION TO THE INVENTION

The present disclosure provides a display panel driving apparatus that can suppress the EMI due to the flow of a large current, without degrading a display image quality.

A first aspect of the present disclosure is a display panel driving apparatus for driving a display panel including a plurality of display cells, each including pixels, in accordance with an inputted image signal, the display panel driving apparatus including: a first latch section that successively reads and holds a pixel data piece for each pixel based on the inputted image signal; a second latch section that successively reads and outputs pixel data pieces every Q pieces with a predetermined time difference therebetween in accordance with a load signal, where Q is an integer equal to or larger than 2; a drive potential generating section that generates a drive potential to drive each of the display cells based on the outputted pixel data pieces; and an output gate section that applies the drive potentials to the respective display cells of the display panel, simultaneously after an elapse of a predetermined time period from a timing of supplying the load signal.

A second aspect of the present disclosure is a display panel driving apparatus for driving a display panel including a plurality of display cells, each including pixels, in accordance with an inputted image signal, the display panel driving apparatus including: a first latch section that successively reads and holds a pixel data piece for each pixel based on the inputted image signal; a time difference adding section that, based on a load signal, generates a plurality of delayed load signals by delaying the load signal with different delay time periods; a second latch section that successively reads and outputs pixel data pieces every Q pieces, in accordance with the respective delayed load signals and the load signal, where Q is an integer equal to or larger than 2; a drive potential generating section that generates a drive potential to drive each of the display cells based the outputted pixel data pieces; an output delay control section that generates an outputs switch signal for turning from an on state to an off state in accordance with the load signal, and turning from the off state to the on state in accordance with a delayed load signal that has a longest delay time period among the delayed load signals; and an output gate section that applies the drive potentials to the respective display cells of the display panel only during a time period that indicates the ON state.

According to the above aspects, the second latch section successively reads pixel data pieces held in the first latch section, and outputs the pixel data pieces every Q pieces thereof, in accordance with the load signal, and with predetermined time differences therebetween. Due thereto, in the above aspects, numerous data bits are not inverted simultaneously. Therefore, the above aspects of the present disclosure can suppress the EMI caused by instantaneous flowing of large current. Further, according to the above aspects of the present disclosure, the drive potentials outputted from the second latch section for driving the display cells in correspondence with each pixel data piece are simultaneously applied to each display cell of the display panel, after elapse of the predetermined time period from the timing of the supply of the load signal. Due thereto, according to the above aspects of the present disclosure, even when the timings of reading each pixel data pieces by the second latch section are forcibly made to differ from each other, each drive potentials in correspondence with the pixel data pieces outputted from the second latch section are simultaneously applied to each display cells. Therefore, the above aspects of the present disclosure can prevent an image quality deterioration caused by shifting the timings of applying the drive potentials to each display cells.

BRIEF DESCRIPTION OF THE DRAWINGS

Exemplary embodiments of the present disclosure will be described in details based on the following figures, wherein.

DETAILED DESCRIPTION

The exemplary embodiments of the present disclosure are described and illustrated below to encompass a display panel driving apparatus for displaying an image based on an inputted image signal, as well as method of fabricating a display panel driving apparatus. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present disclosure. It should be noted that the drawings are solely for description and are not to limit the technical scope of the present invention.

A first latch section reads and holds pixel data pieces for each pixel based on an inputted image signal in series. A second latch section successively reads and outputs the pixel data pieces held at the first latch section every Q pieces, in accordance with a load signal, with predetermined time differences therebetween. Drive potentials for driving a display cells in correspondence with the respective pixel data pieces outputted from the second latch section are applied to the respective display cells after elapse of a predetermined time period from a time point of supplying the load signal.

First Exemplary Embodiment

Figure 1:
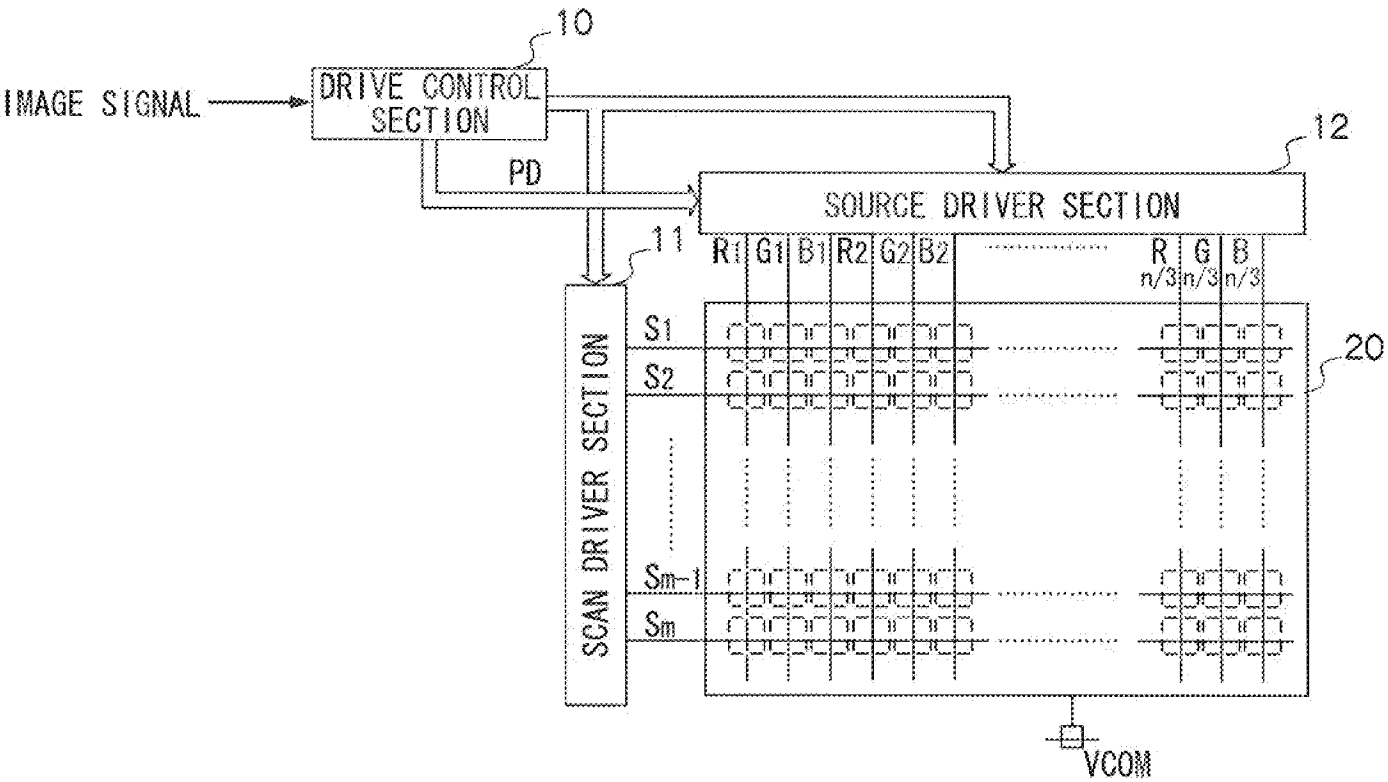
FIG. 1 is a diagram showing an outline configuration of a liquid crystal display apparatus including a driving apparatus according to the present disclosure.

FIG. 1 is a diagram showing an outline configuration of a liquid display apparatus including a source driver as a driving apparatus according to the present disclosure.

As shown in FIG. 1, the liquid crystal display apparatus is configured by including, a drive control section 10, a scan driver section 11, a source driver section 12, and a color TFT (thin film transistors) liquid crystal panel as a display panel 20.

In the display panel 20, m scan lines of $S_1$ through $S_m$ that extends in a horizontal direction of a two-dimensional screen, and n source lines (red color source lines $R_1$ through $R_{n/3}$, green color source lines $G_1$ through $G_{n/3}$, blue color source lines $B_1$ through $B_{n/3}$) that extends in a vertical direction of the two-dimensional screen, in order to drive a liquid crystal layer (not illustrated) is formed. Further, a display cell assumed by one pixel (red color pixel, green color pixel, or blue color pixel) is formed in each region where the scan line and the source line intersects to each other (region surrounded by broken lines). Each display cell includes a transistor (not illustrated). The transistor is switched ON in accordance with a scan pulse which is supplied from the scan driver section 11 via the scan line. In the ON state, the transistor applies a pixel drive potential to one electrode out of the electrodes (not illustrated) that interpose the liquid crystal layer. The pixel drive potential is supplied from the source driver section 12 via the source line. Further, other electrodes fixedly applied with a predetermined reference potential VCOM. Each display cell displays with a brightness in correspondence with a potential applied by the pixel drive potential and the reference potential VCOM.

The drive control section 10 generates a frame synchronize signal that indicates drive timings for each frames, and various drive control signals (mentioned later) based on the inputted image signal. Further, the drive control section 10 supplies various drive control signals to the scan driver section 11 and the source driver section 12. Further, the drive control section 10 generates a pixel data PD that indicates the brightness levels of each pixel by, for example, 8 bits, based on the input image signal, in series. Then, the drive control section 10 supplies each 6 pieces of the pixel data PD to the source driver section 12.

The drive control section 10 supplies the pixel data PD that bears to red color within the pixel data PD series that corresponds to pixels for one scan line, as pixel data series $P_{R1}$ to which pixel data PD that are aligned at odd number orders, and as pixel data series $P_{R2}$ to which pixel data PD that are aligned at even number orders, to the source driver section 12. Further, the drive control section 10 supplies the pixel data PD that bears to green color within the pixel data PD series that corresponds to pixels for one scan line, as pixel data series $P_{G1}$ to which pixel data PD that are aligned at odd number orders, and as pixel data series $P_{G2}$ to which pixel data PD that are aligned at even number orders, to the source driver section 12. Further, the drive control section 10 supplies the pixel data PD that bears to blue color within the pixel data PD series that corresponds to pixels for one scan line, as pixel data series $P_{B1}$ to which pixel data PD that are aligned at odd number orders, and as pixel data Series $P_{B2}$ to which pixel data PD that are aligned at even number orders, to the source driver section 12.

Figure 2:
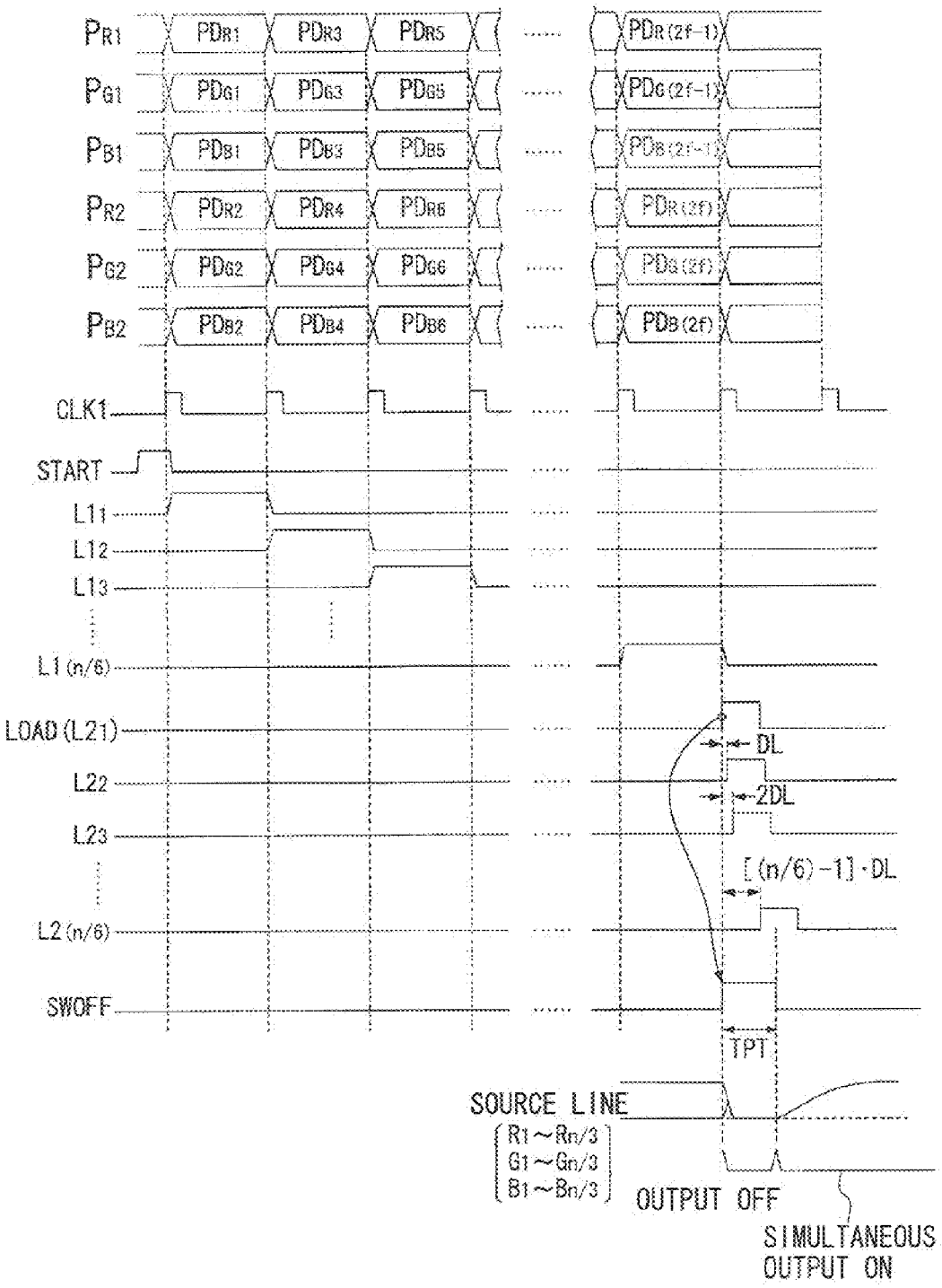
FIG. 2 is a diagram showing an operation of a driving apparatus according to a first exemplary embodiment.

For example, as shown in FIG. 2, the drive control section 10 supplies each pixel data PD simultaneously to the source driver section 12 in accordance with a first clock pulse of a clock signal CLK1, and the supplied pixel data PD are:

$PD_{R1}$ as first pixel data PD of pixel data series $P_{R1}$;
$PD_{G1}$ as first pixel data PD of pixel data series $P_{G1}$;
$PD_{B1}$ as first pixel data PD of pixel data series $P_{B1}$;
$PD_{R2}$ as first pixel data PD of pixel data series $P_{R2}$;
$PD_{G2}$ as first pixel data PD of pixel data series $P_{G2}$;
$PD_{B2}$ as first pixel data PD of pixel data series $P_{B2}$.

Next, in accordance with a second clock pulse of the clock signal CLK1, the drive control section 10 simultaneously supplies each pixel data PD to the source driver section 12, and the supplied pixel data PD are:

$PD_{R3}$ as second pixel data PD of pixel data series $P_{R1}$;
$PD_{G3}$ as second pixel data PD of pixel data series $P_{G1}$;
$PD_{B3}$ as second pixel data PD of pixel data series $P_{B1}$;
$PD_{R4}$ as second pixel data PD of pixel data series $P_{R2}$;
$PD_{G4}$ as second pixel data PD of pixel data series $P_{G2}$;
$PD_{B4}$ as second pixel data PD of pixel data series $P_{B2}$.

Next, in accordance with a third clock pulse of the clock signal CLK1, the drive control section 10 simultaneously supplies each pixel data PD to the source driver section 12, and the supplied pixel data PD are:

$PD_{R5}$ as third pixel data PD of pixel data series $P_{R1}$;
$PD_{G5}$ as third pixel data PD of pixel data series $P_{G1}$;
$PD_{B5}$ as third pixel data PD of pixel data series $P_{B1}$;
$PD_{R6}$ as third pixel data PD of pixel data series $P_{R2}$;
$PD_{G6}$ as third pixel data PD of pixel data series $P_{G2}$;
$PD_{B6}$ as third pixel data PD of pixel data series $P_{B2}$.

The scan driver section 11 generates a scan pulse having a predetermined peak potential in accordance with the frame synchronize signal supplied from the drive control section 10. Then, the scan driver section 11 alternatively applies the scan pulse in series, to the each scan line $S_1$ through $S_m$ of the display panel 20.

The source driver section 12 reads 6 routes of pixel data series (i.e., pixel data PD of each pixel which are pixel data series $P_{R1}$, $P_{G1}$, $P_{B1}$, $P_{R2}$, $P_{G2}$ and $P_{B2}$) supplied from the drive control section 10. Then, the source driver section 12 generates drive pulses for one scan line (n pieces) at a time, having peak potentials that correspond to the brightness levels indicated by the pixel data PD. The source driver section 12 applies one scan line's worth (n pieces) of drive pulses corresponding with the respective pixels belonging to a scan line that is the object of application of the scan pulses, to respective corresponding source lines (R1 through $R_{n/3}$, $G_1$ through $G_{n/3}$, $B_1$ through $B_{n/3}$), in synchronism with respective scan pulses.

Figure 3:
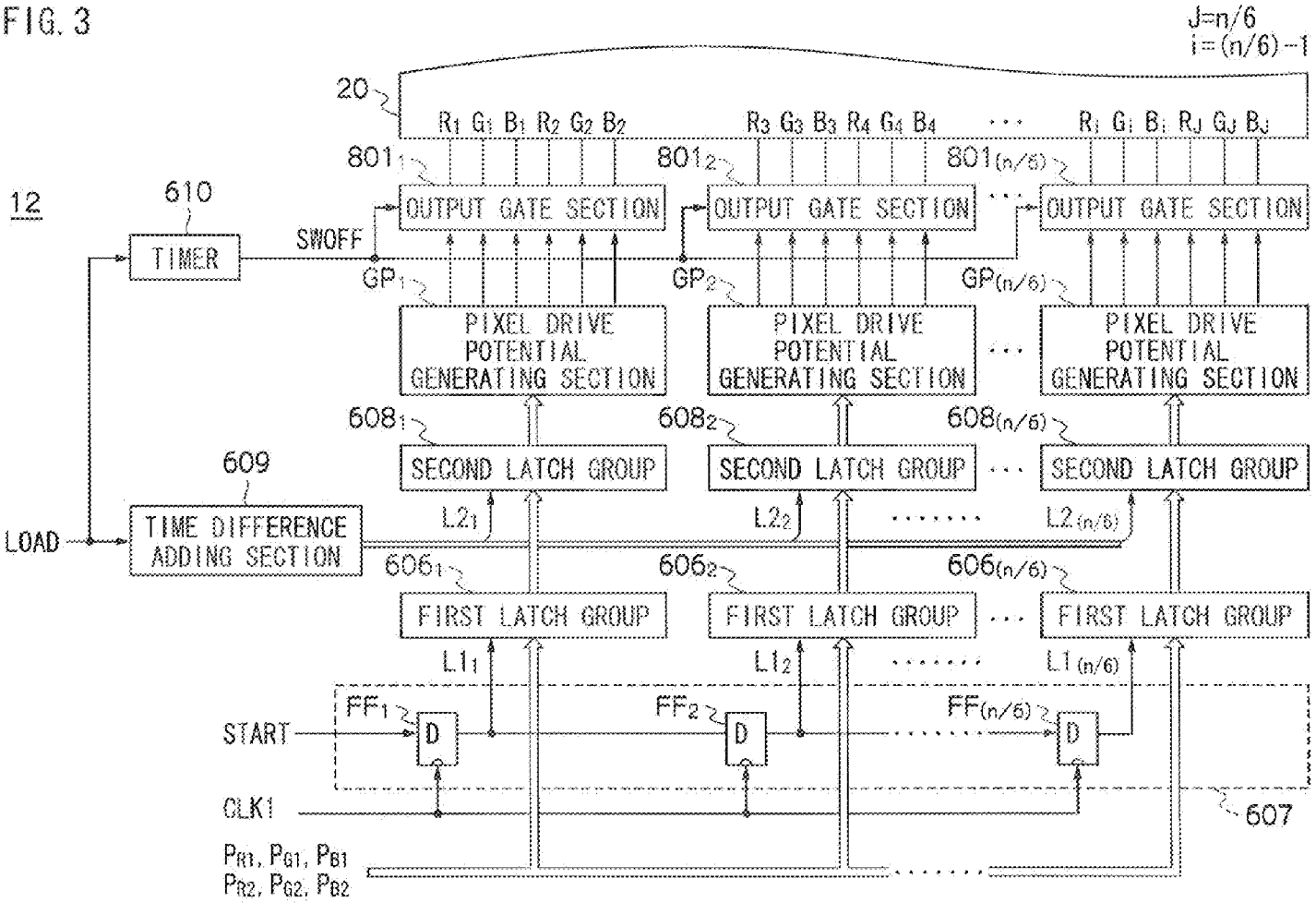
FIG. 3 is a diagram showing a configuration of a source driver section 12 according to the first exemplary embodiment.

FIG. 3 is a diagram showing an outline configuration of the source driver section 12.

As shown in FIG. 3, the source driver section 12 includes, first latch groups $\mathbf{606}_1$ through $\mathbf{606}_{(n/6)}$, a shift register 607, second latch groups $\mathbf{608}_1$ to $\mathbf{608}_{(n/6)}$, a time difference adding section 609, delay elements $\mathbf{609}_1$ through $\mathbf{609}_{(n/6)-1}$, pixel drive potential generating sections $GP_1$ through $GP_{(n/6)}$, a timer 610, and output gate sections $\mathbf{801}_1$ through $\mathbf{801}_{(n/6)}$.

Figure 4:
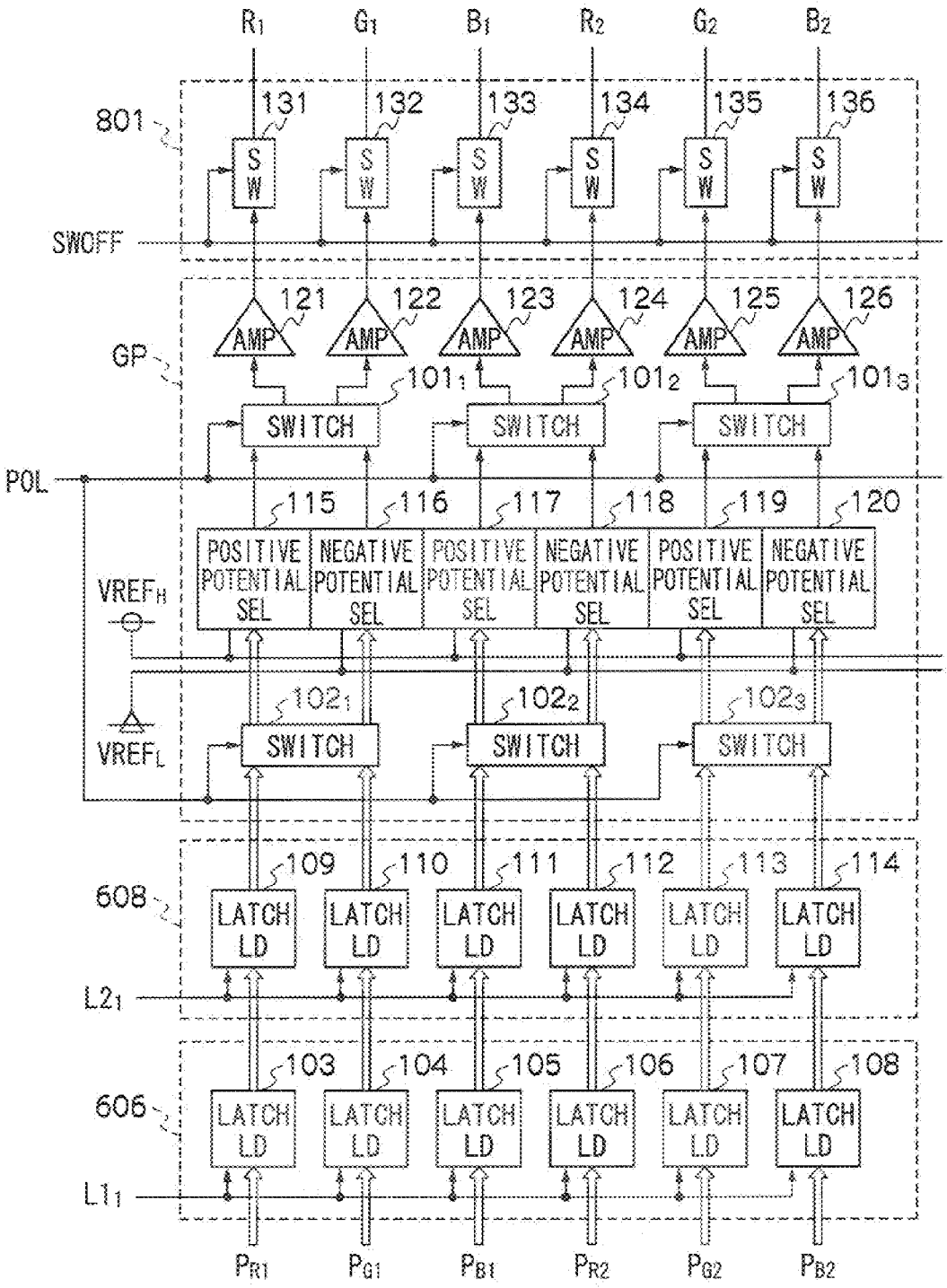
FIG. 4 is a diagram showing the detailed configuration of a first latch group $\mathbf{606}_1$, a second latch group $\mathbf{608}_1$, a pixel drive potential generating section $GP_1$ and an output gate section $\mathbf{801}_1$.

FIG. 4 is a diagram showing configurations of the first latch group $\mathbf{606}_1$, the second latch group $\mathbf{608}_1$, the pixel drive potential generating section $GP_1$ and the output gate section $\mathbf{801}_1$ which are shown in FIG. 3.

The shift register 607 is configured by including flip flops $FF_1$ through $FF_{(n/6)}$. As shown in FIG. 2, the flip flops $FF_1$ through $FF_{(n/6)}$ shifts START signals to later stages, in accordance to the clock signal CLK1, that are transmitted each time when the drive control section 10 starts a drive operation for one scan line. Output signals of the flip flops $FF_1$ through $FF_{(n/6)}$ are supplied to the corresponding first latch groups $\mathbf{606}_1$ through $\mathbf{606}_{(n/6)}$ as first load signals $L\mathbf{1}_1$ through $L\mathbf{1}_{(n/6)}$ respectively, as shown in FIG. 2.

The first latch groups $\mathbf{606}_1$ through $\mathbf{606}_{(n/6)}$ are each configured by the same inner configuration (that is, latches 103 through 108 as shown in FIG. 4). The latches 103 through 108 each reads and stores the pixel data PD included in pixel data series $P_{R1}$, $P_{G1}$, $P_{B1}$, $P_{R1}$, $P_{G2}$ and $P_{B2}$ in accordance with the first load signal L1 supplied from the shift register 607. Then, the latches 103 through 108 transmit the pixel data PD to the second latch group 608.

For example, the latches 103 through 108 of the first latch group $\mathbf{606}_1$ reads and stores the pixel data PD respectively, in accordance with the first load signal $L\mathbf{1}_1$ as shown in FIG. 2, and transmit the pixel data PD to the second latch group $\mathbf{608}_1$. The transmitted pixel data PD are:

first pixel data $PD_{R1}$ in pixel data series $P_{R1}$;
first pixel data $PD_{G1}$ in pixel data series $P_{G1}$;
first pixel data $PD_{B1}$ in pixel data series $P_{B1}$;
first pixel data $PD_{R2}$ in pixel data series $P_{R2}$;
first pixel data $PD_{G2}$ in pixel data series $P_{G2}$;
first pixel data $PD_{B2}$ in pixel data series $P_{B2}$.

Further, for example, the latches 103 through 108 of the first latch group $\mathbf{606}_2$ reads and store the pixel data PD respectively, in accordance with the first load signal $L\mathbf{1}_2$ as shown in FIG. 2, and transmit the pixel data PD to the second latch group $\mathbf{608}_2$. The transmitted pixel data PD are:

second pixel data $PD_{R3}$ in pixel data series $P_{R1}$;
second pixel data $PD_{G3}$ in pixel data series $P_{G1}$;
second pixel data $PD_{B3}$ in pixel data series $P_{B1}$;
second pixel data $PD_{R4}$ in pixel data series $P_{R2}$;
second pixel data $PD_{G4}$ in pixel data series $P_{G2}$;
second pixel data $PD_{B4}$ in pixel data series $P_{B2}$.

Further, for example, the latches 103 through 108 of the first latch groups $\mathbf{606}_3$ reads and store the pixel data PD respectively, in accordance with the load signal $L\mathbf{1}_3$ as shown in FIG. 2, and transmit the pixel data PD to the second latch group $\mathbf{608}_3$. The transmitted pixel data PD are:

third pixel data $PD_{R5}$ in pixel data series $P_{R1}$;
third pixel data $PD_{G5}$ in pixel data series $P_{G1}$;
third pixel data $PD_{B5}$ in pixel data series $P_{B1}$;
third pixel data $PD_{R6}$ in pixel data series $P_{R2}$;
third pixel data $PD_{G6}$ in pixel data series $P_{G2}$;
third pixel data $PD_{B6}$ in pixel data series $P_{B2}$.

In accordance with the first load signals $L\mathbf{1}_4$ through $L\mathbf{1}_{(n/6)}$ as shown in FIG. 2, the pixel data PD are read in series to each first latch groups $\mathbf{606}_4$ through $\mathbf{606}_{(n/6)}$ respectively. Namely, the pixel data PD for one scan line are read in the first latch groups $\mathbf{606}_1$ through $\mathbf{606}_{(n/6)}$. Next, as shown in FIG. 2, the drive control section 10 supplies a load signal LOAD to the time difference adding section 609.

Figure 5:
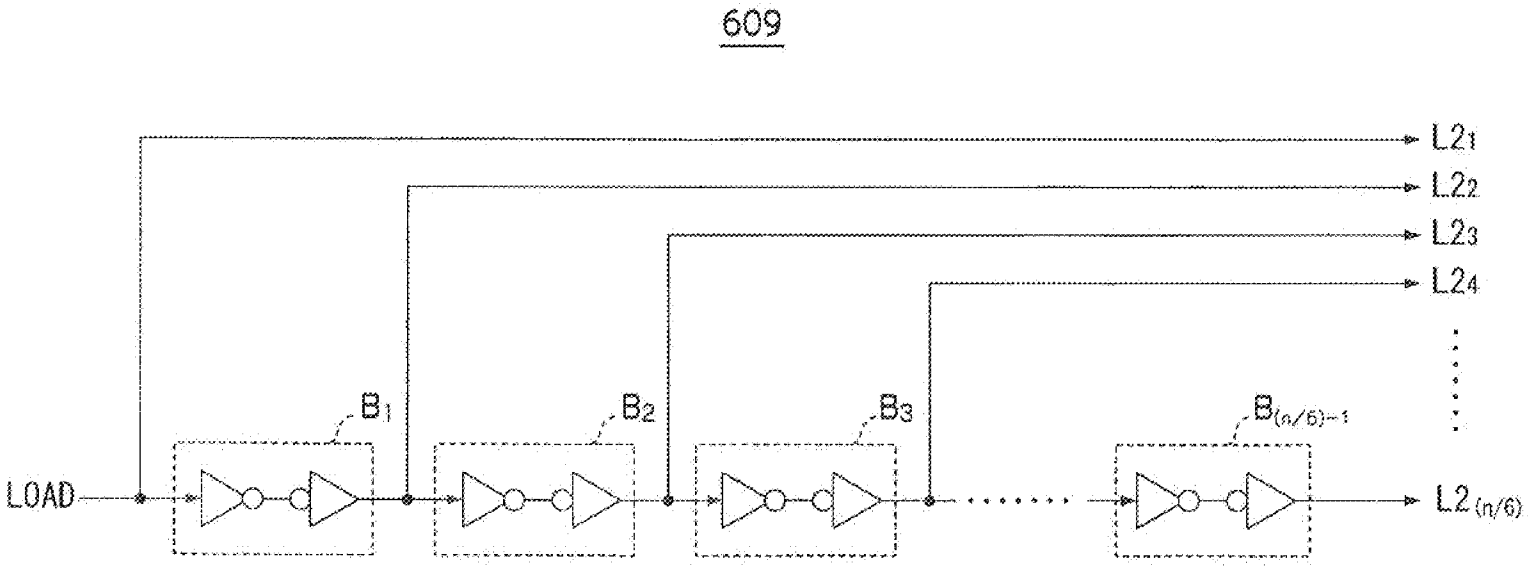
FIG. 5 is a diagram showing an example configuration of a time difference adding section 609 shown in FIG. 3.

As shown in FIG. 2, the time difference adding section 609 supplies the load signal LOAD as it is to the second latch group $\mathbf{608}_1$ as a second load signal $L\mathbf{2}_1$. Further, the time difference adding section 609 supplies the load signal LOAD to respective second latch groups $\mathbf{608}_2$ through $\mathbf{608}_{(n/6)}$ as second load signals $L\mathbf{2}_2$ through $L\mathbf{2}_{(n/6)}$ that are respectively outputted having different lime differences. For example, as shown in FIG. 5, the time difference adding section 609 is configured by buffers $B_1$ through $B_{(n/6)-1}$ which are configured by connecting two inverter elements in series. Each outputs of the buffers $B_1$ through $B_{(n/6)-1}$ are to be second load signals $L\mathbf{2}_2$ through $L_{2(n/6)}$ respectively. Each buffers $B_1$ through $B_{(n/6)-1}$ functions as delay elements that outputs input signals after an time elapse of delay time DL, delayed by two inverter elements. Accordingly, the second load signal $L\mathbf{2}_2$ is outputted with a delay of DL from the second load signal $L\mathbf{2}_1$. Further, the second load signal $L\mathbf{2}_3$ is outputted with a delay of 2·DL from the second load signal $L\mathbf{2}_1$. Further, the second load signal $L\mathbf{2}_{(n/6)}$ is outputted with a delay of [(n/6)−1]·DL from the second load signal $L\mathbf{2}_1$.

The second latch groups $\mathbf{608}_1$ through $\mathbf{608}_{(n/6)}$ are configured by the same inner configuration (i.e., latches 109 through 114 as shown in FIG. 4). The latches 109 through 114 read and store the pixel data PD supplied from the latches 103 through 108 of the first latch group 606 of a preceding stage respectively, in accordance with the second load signal. Then, the latch 109 through 114 transmits the pixel data PD to the pixel drive potential generating section GP.

As shown in FIG. 2, for example, the latches 109 through 114 of the second latch group $\mathbf{608}_1$ read and store the each pixel data PD supplied from the latches 103 through 108 of the first latch group $\mathbf{606}_1$ respectively, in accordance with the second load signal $L\mathbf{2}_1$ by the timing which are the same as those of the load signal LOAD. Then, the latches 109 through 114 of the second latch group $\mathbf{608}_1$ transmit the pixel data PD to the pixel drive potential generating section $GP_1$.

As shown in FIG. 2, the latches 109 through 114 of the second latch group $\mathbf{608}_2$ read and store the each pixel data PD supplied from the latches 103 through 108 of the first latch group $\mathbf{606}_2$ respectively, in accordance with the second load signal $L\mathbf{2}_2$ with a timing delay of the delay time DL from the second load signal $L\mathbf{2}_1$. Then, the latches 109 through 114 of the second latch group $\mathbf{608}_2$ transmit the pixel data PD to the pixel drive potential generating section $GP_2$.

As shown in FIG. 2, the latches 109 through 114 of the second latch group $\mathbf{608}_3$ read and store the each pixel data PD supplied from the latches 103 through 108 of the first latch group $\mathbf{606}_3$ respectively, in accordance with the second load signal $L\mathbf{2}_3$ with a timing delay of 2·DL from the second load signal $L\mathbf{2}_1$. Then, the latches 109 through 114 of the second latch group $\mathbf{608}_3$ transmit the pixel data PD to the pixel drive potential generating section $GP_3$.

Continuously, in accordance with second load signals $L\mathbf{2}_4$ through $L\mathbf{2}_{(n/6)}$ as shown in FIG. 2, the pixel data PD are inputted in series to the second latch groups $\mathbf{608}_4$ through $\mathbf{608}_{(n/6)}$ respectively.

Accordingly, each time all of the pixel data PD for one scan line is input to the first latch groups $\mathbf{606}_1$ through $\mathbf{606}_{(n/6)}$, the second latch groups $\mathbf{608}_1$ through $\mathbf{608}_{(n/6)}$ read and output each pixel data PD for one scan line every 6 pieces, at the predetermined time difference (DL). Namely, actual timings for reading the pixel data PD by each second latch group $\mathbf{608}_1$ through $\mathbf{608}_{(n/6)}$ are shifted forcibly by the time difference adding section 609. Accordingly, in the second latch groups $\mathbf{608}_1$ through $\mathbf{608}_{(n/6)}$, even when a numerous bit inversions occur from the data for one scan line read previously, large current does not flow instantaneously. Therefore, according to the first exemplary embodiment of the present disclosure, occurrence of EMI can be suppressed.

Each pixel drive potential generating section $GP_1$ through $GP_{(n/6)}$ includes, the same inner configuration, as shown in FIG. 4. Each pixel drive potential generating section $GP_1$ through $GP_{(n/6)}$ includes, switches $\mathbf{102}_1$ through $\mathbf{102}_3$, positive potential selectors 115, 117, 119, negative potential selectors 116, 118, 120, switches $\mathbf{101}_1$ through $\mathbf{101}_3$, odd number column amplifiers 121, 123, 125, and even number column amplifiers 122, 124, 126.

The switches $\mathbf{102}_1$ ($\mathbf{102}_2$, $\mathbf{102}_3$) supplies each pixel data PD respectively to the positive potential selector 115 (117, 119) and the negative potential selector 116, (118, 120) in accordance with a polarity inversion signal POL supplied from the drive control section 10. Further, the each pixel data PD are supplied from the latch 109 (111, 113) and the latch 110 (112, 114) of the second latch group 608. For example, the switch $\mathbf{102}_1$ supplies the pixel data PD supplied from the latch 109 of the second latch group 608 to the positive potential selector 115 when the polarity inversion signal POL is at logical level 1. Along therewith, the switch $\mathbf{102}_1$ supplies the pixel data PD supplied from the latch 110 of the second latch group 608 to the negative potential selector 116. On the other hand, when the polarity inversion signal POL is at logical level 0, the switch $\mathbf{102}_1$ supplies the pixel data PD supplied from the latch 109 of the second latch group 608 to the negative potential selector 116. Along therewith, the switch $\mathbf{102}_1$ supplies the pixel data PD supplied from the latch 110 of the second latch group 608 to the positive potential selector 115.

The positive potential selector 115 (117, 119) selects a potential in accordance to the brightness level indicated by the pixel data PD supplied from the switch $\mathbf{102}_1$ ($\mathbf{102}_2$, $\mathbf{102}_3$). The potential is selected from potentials that are higher than the reference potential VCOM out of various potentials divided by a reference potential $VREF_H$ higher than the reference potential VCOM, and a reference potential $VREF_L$ lower than the reference potential VCOM. Further, the positive potential selector 115 (117, 119) supplies the selected potential to the switch $\mathbf{101}_1$ ($\mathbf{101}_2$, $\mathbf{101}_3$) as a positive polarity brightness potential PV.

The negative potential selector 116 (118, 120) selects a potential in accordance to the brightness level indicated by the pixel data PD supplied from the switch $\mathbf{102}_1$ ($\mathbf{102}_2$, $\mathbf{102}_3$). The potential is selected from respective potentials lower than the reference potential VCOM, out of various potentials divided by the reference potentials $VREF_{11}$ and $VREF_1$. Further, the negative potential selector 116 (118, 120) supplies the selected potential to the switch $\mathbf{101}_1$, ($\mathbf{101}_2$, $\mathbf{101}_3$) as a negative polarity brightness potential NV.

The switch $\mathbf{101}_1$ ($\mathbf{101}_2$, $\mathbf{101}_3$) supplies the negative polarity brightness polarities NV and the positive polarity brightness potentials PV to the odd number column amplifier (121, 123, 125) and the even number column amplifier (122, 124, 126) in accordance with the polarity inversion signal POL supplied from the drive control section 10. For example, the switch $\mathbf{101}_1$ supplies the positive polarity brightness potential PV supplied from the positive potential selector 115 to the odd number column amplifier 121 when the polarity inversion signal POL is at logical level 1. Along therewith, the switch $\mathbf{101}_1$ supplies the negative polarity brightness potential NV supplied from the negative potential selector 116 to the even number column amplifier 122. On the other hand, when the polarity inversion signal POL is at logical level 0, the switch $\mathbf{101}_1$ supplies the positive polarity brightness potential PV supplied from the positive potential selector 115 to the even number column amplifier 122. Along therewith, the switch 101 supplies the negative polarity brightness potential NV supplied from the negative potential selector 116 to the odd number column amplifier 121.

The odd number column amplifier 121 (123, 125) and the even number column amplifier 122 (124, 126) amplify the negative polarity brightness potential NV or the positive polarity brightness potential PV to a potential capable for driving the liquid crystal layer of the display panel 20. Then, the odd number column amplifier 121 (123, 125) and the even number column amplifier 122 (124, 126) supply the amplified potentials to switching elements (131 through 136) of the output gate sections ($\mathbf{801}_1$ through $\mathbf{801}_{(n/6)}$) as pixel drive potentials in correspondence with each pixel.

Accordingly, the pixel drive potential generating section GP converts the brightness levels of each pixel, based on the inputted image signal into the negative polarity brightness potentials NV or the positive polarity brightness potentials PV in correspondence with the brightness levels. Further, the pixel drive potential generating section GP generates the converted potentials as the pixel drive potentials that are to be applied to each pixel via the source lines ($R_1$ through $R_{n/3}$, $G_1$ through $G_{n/3}$, $B_1$ through $B_{n/3}$) of the display panel 20. In the pixel drive potential generating section GP, when the pixel drive potential of one of the pixel that adjusts to each other is set to the negative polarity brightness potential NV, the pixel drive potential of the other pixel is set to the positive polarity brightness potential PV. For example, when the polarity inversion signal POL is at logical level 1, the pixel data PD transmitted from the latch 109 of the second latch group 608 is supplied to the positive potential selector 115 via the switch $\mathbf{102}_1$. Then, the positive polarity brightness potential PV provided by the positive potential selector 115 is transmitted to the amplifier 121 via the switch $\mathbf{101}_1$. Further, when the polarity inversion signal POL is at logical level 1, the pixel data PD transmitted from the latch 110 of the second latch group 608 is supplied to the negative potential selector 116 via the switch $\mathbf{102}_1$. Then the negative polarity brightness potential NV provided by the negative potential selector 116 is transmitted to the amplifier 122 via the switch $\mathbf{101}_1$. Namely, at this occasion, the positive polarity brightness potential PV is transmitted from the amplifier 121. Further, the pixel drive potential in correspondence with the negative polarity brightness potential NV is transmitted from the amplifier 122 which is in correspondence with the pixel contiguous to the pixel in correspondence with the amplifier 121. On the other hand, when the polarity inversion signal POL is at logical level 0, the pixel data PD transmitted from the latch 109 of the second latch group 608 is supplied to the negative potential selector 116 via the switch $\mathbf{102}_1$. The negative polarity brightness potential NV provided by the negative potential selector 116 is transmitted to the amplifier 121 via the switch $\mathbf{101}_1$. Further, when the polarity inversion signal POL is at logical level 0, the pixel data PD transmitted from the latch 110 of the second latch group 608 is supplied to the positive potential selector 115 via the switch $\mathbf{102}_1$. The positive polarity brightness potential PV provided by the positive potential selector 115 is transmitted to the amplifier 122 via the switch $\mathbf{101}_1$. That is, at this occasion, the negative polarity brightness potential NV is transmitted from the amplifier 121. Further, the pixel drive potential in correspondence with the positive polarity brightness potential PV is transmitted from the amplifier 122. Here, when the pixel drive potential is applied to one electrode of respective electrodes interposing the liquid crystal layer of the display panel 20, other electrode is fixedly applied with the reference potential VCOM which is higher than the negative polarity brightness potential NV and lower than the positive polarity brightness potential PV. Therefore, when the positive polarity brightness potential PV is applied as the pixel drive potential, the liquid crystal layer of the display panel 20 is applied with the positive polarity drive potential. On the other hand, when the negative polarity brightness potential NV is applied as the pixel drive potential, the liquid crystal layer of the display panel 20 is applied with the negative polarity drive potential.

Namely, at the pixel drive potential generating section GP generate the pixel drive potentials that are to be applied to each pixel via the source lines ($R_1$ through $R_{n/3}$, $G_1$ through $G_{n/3}$, $B_1$ through $B_{n/3}$) of the display panel 20. At this occasion, the pixel drive potential generating section GP inverts the polarities of the respective pixels contiguous to each other. Along therewith, the pixel drive potential generating section GP is configured to change the inversion state, in accordance with the polarity inversion signal POL.

Each pixel drive potentials generated by the pixel drive potential generating sections GP through $GP_{(n/6)}$ and that corresponds to the respective pixels of one scan line, are respectively supplied to the switching elements 131 through 136 of the output gate sections $\mathbf{801}_1$ through $\mathbf{801}_{(n/6)}$ respectively.

The timer 610 generates an output switch signal SWOFF as shown in FIG. 2. The output switch signal SWOFF is seat to logical level 1 within a predetermined time period TPT from a rise of the load signal LOAD, and is set to logical level 0 in other time period. The timer 610 supplies the output switch signal SWOFF to the switching elements 131 through 136 of the output gate sections $\mathbf{801}_1$ through $\mathbf{801}_{(n/6)}$.

The switching elements 131 through 136 are turned to ON state only during a time period in which the output switch signal SWOFF is in logical level 0, as shown in FIG. 2. Further, the switching elements 131 through 136 transmit the pixel drive potentials generated by the pixel drive potential generating section GP to the source lines ($R_1$ through $R_{n/3}$, $G_1$ through $C_{n/3}$, $B_1$ through $B_{n/3}$) of the display panel 20. On the other hand, during a time period in which the output switch signal SWOFF is in logical level 1 (i.e., an interval until an elapse of the predetermined time period TPT from a time point at which the load signal LOAD transits from logical level 0 to logical level 1), the switching elements 131 through 136 are turned to OFF state. In OFF state, the switching elements 131 through 136 bring the source lines ($R_1$ through $R_{n/3}$, $G_1$ through $G_{n/3}$, $B_1$ through $B_{n/3}$) of the display panel 20 into a high impedance state. Further, the predetermined time period TPT is longer than a time period from when supply of the second load signal $\mathbf{L2}_1$ that corresponds to the load signal LOAD to the second latch group $\mathbf{608}_1$ is initiated to when supply of the second load signal $\mathbf{L2}_{(n/6)}$ to the second latch group $\mathbf{608}_{(n/6)}$ is initiated (i.e., $[(n/6)-1]\cdot DL$). Namely, the predetermined time period TPT is longer than the time period required from the time at which supply of the load signal LOAD is initiated (the timing at which the logic level has changed from logic level 0 to logic level 1) until all of the pixel data PD for one scan line has been input to the second latch group ($\mathbf{608}_1$ through $\mathbf{608}_{(n/6)}$).

Here, according to the second load signals $\mathbf{L2}_1$ through $\mathbf{L2}_{(n/6)}$, the respective second latch groups $\mathbf{608}_1$ through $\mathbf{608}_{(n/6)}$ reads the pixel data PD by time differences respectively different from each other. Therefore, timings of outputting the respective pixel drive potentials outputted from the pixel drive potential generating sections $GP_1$ through $GP_{(n/6)}$ are shifted from each other by the time differences. Therefore, when pixel drive potentials outputted from the pixel drive potential generating sections $GP_1$ through $GP_{(n/6)}$ are applied to the capacitive display panel 20 such as a liquid crystal display panel, charge amounts charged to each pixel becomes nonuniform in accordance with shifts of output timings. Therefore, in this case, deterioration in an image quality may occur.

Hence, according to the source driver section 12 shown in FIG. 3 and FIG. 4, the output gate sections $\mathbf{801}_1$ through $\mathbf{801}_{(n/6)}$ are simultaneously turned to ON state after all of the pixel drive potentials have been outputted from the pixel drive potential generating sections $GP_1$ through $GP_{(n/6)}$. Thereby, the source driver section 12 simultaneously applies the pixel drive potentials to each source lines ($R_1$ through $R_{n/3}$, $G_1$ through $G_{n/3}$, $B_1$ through $B_{n/3}$) of the display panel 20.

Therefore, according to the source driver section 12, even when the timings of reading the pixel data at the second latch groups $\mathbf{608}_1$ through $\mathbf{608}_{(n/6)}$ are forcibly made to differ from each other, in order to restrain an instantaneous large current constituting a factor of bringing about EMI, the charge amounts for charging each pixel by applying the pixel drive potentials for one scan line become uniform. Therefore, in the source driver section 12 according to the first exemplary embodiment, the image quality deterioration as in the above-described case does not occur. Namely, in the source driver section 12 according to the first exemplary embodiment, occurrence of EMI can be restrained without deteriorating the image quality.

Second Exemplary Embodiment

Figure 6:
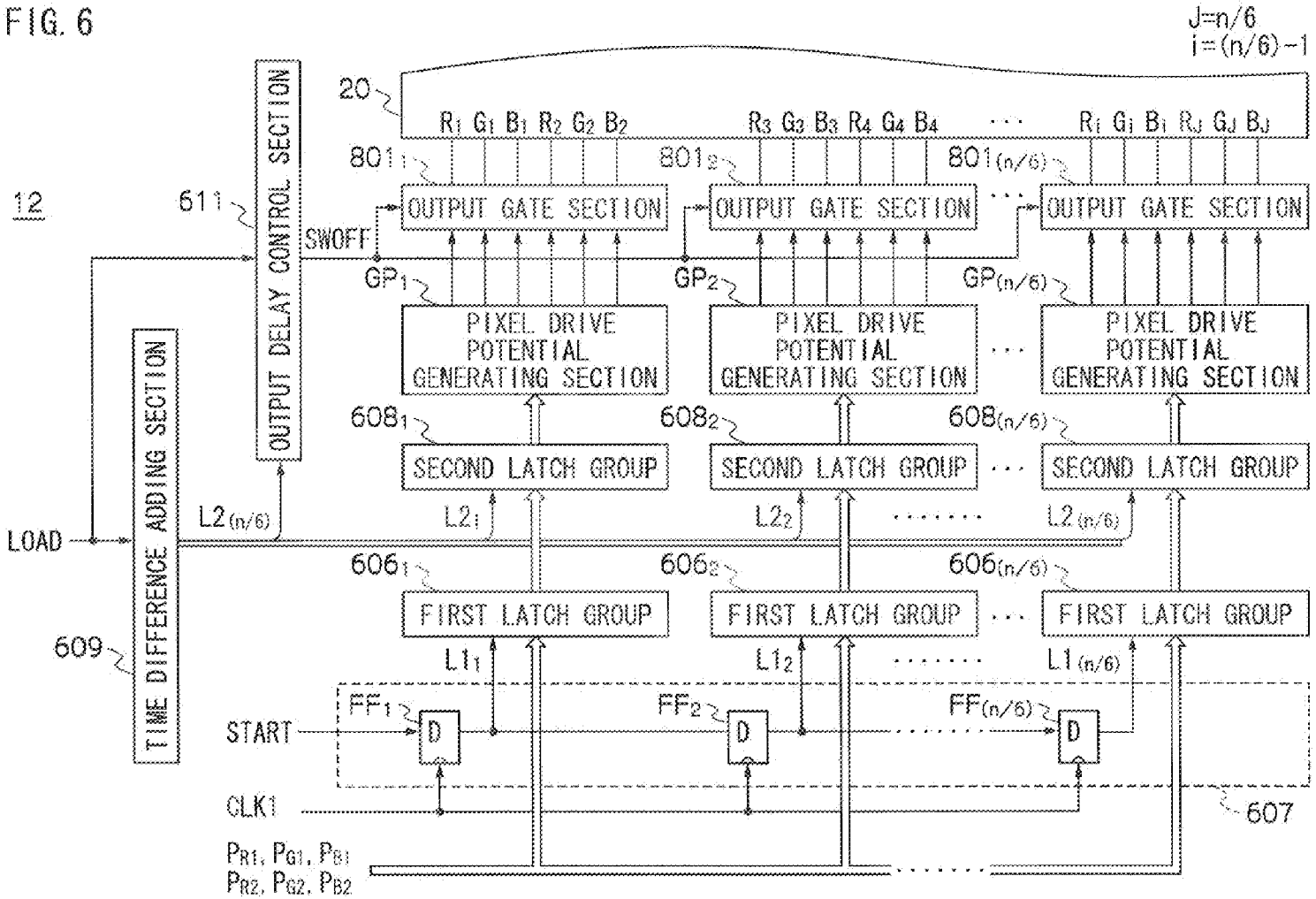
FIG. 6 is a diagram showing a configuration of the source driver section 12 according to a second exemplary embodiment.

FIG. 6 is a diagram showing an outline configuration of a liquid crystal display apparatus including a source driver as a driving apparatus according to the present disclosure.

Figure 7:
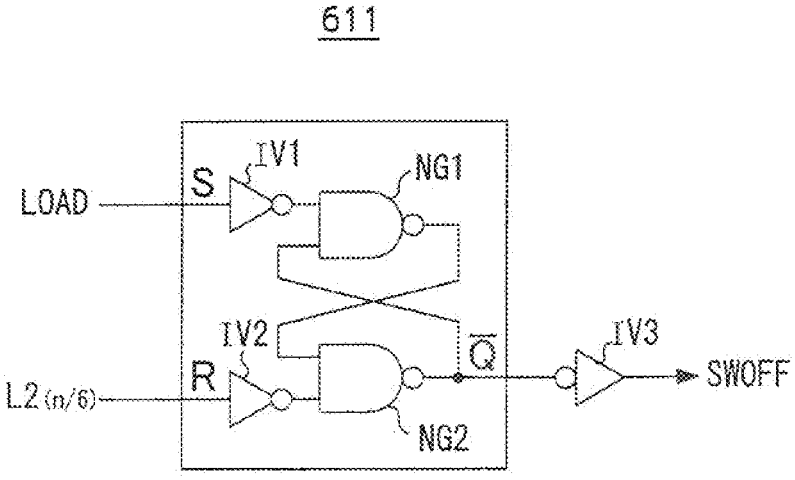
FIG. 7 is a diagram showing an example configuration of an output delay control section 611 shown in FIG. 6.

Further, according to the configuration as shown in FIG. 6, in place of the timer 610 shown in FIG. 3, an output delay control section 611 having an inner configuration as shown in FIG. 7 is adopted. Other configurations except this point are the same as shown in FIG. 3.

An explanation will be given of an operation of generating the output switch signal SWOFF by the output delay control section 611 as follows.

As shown in FIG. 7, the output delay control section 611 is configured including an RS flip flop and an inverter IV3. The RS flip flop is configured including, inverters IV1, IV2, and NAND gates NG1 and NG2. The inverter IV3 transmits an inverted logical level of an inverted output terminal Q of the RS flip flop, as the output switch signal SWOFF. An S terminal of the RS flip flop is supplied with the load signal LOAD as described above. An R terminal of the RS flip flop is supplied with the second load signal $L2_{(n/6)}$ which is delayed from the load signal LOAD by [(n/6)−1]·DL.

Figure 8:
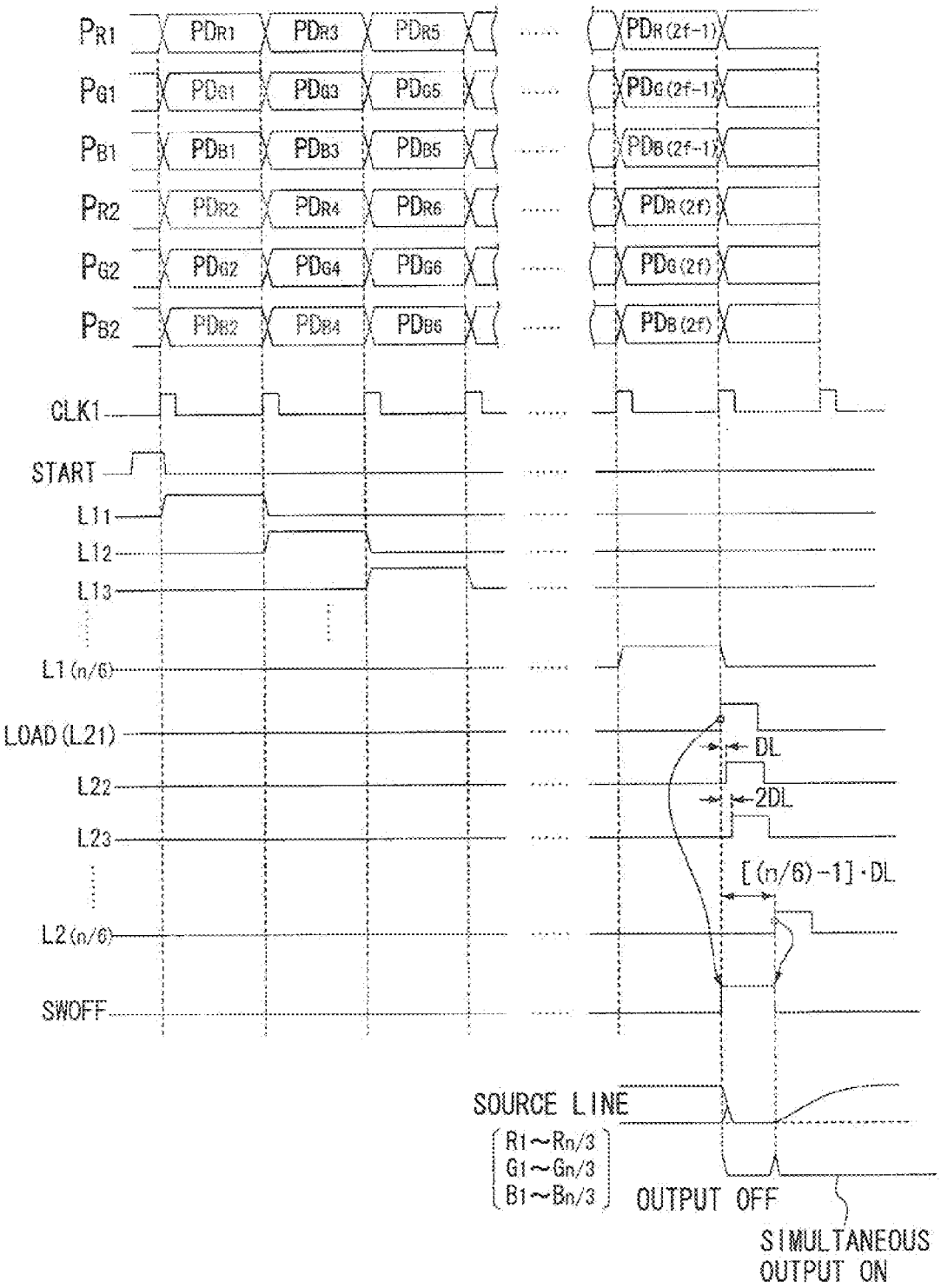
FIG. 8 is a diagram showing an operation example of the driving apparatus according to the second exemplary embodiment.

By the above-described configuration, the output delay control section 611 generates the output switch signal SWOFF as shown in FIG. 8. Further, the output delay control section 611 supplies the output switch signal SWOFF to the switching elements 131 through 136 of the output gate sections $801_1$ through $801_{(n/6)}$. In the output switch signal SWOFF, logical level is set to 1 during a time period from the timing of raise of the load signal LOAD till the timing of raise of the second load signal $L2_{(n/6)}$, and logical level is set to 0 during other time period.

Therefore, similar to the configuration shown in FIG. 3, the output gate sections $801_1$ through $801_{(n/6)}$ are simultaneously turned to the ON state immediately after outputting all of the pixel drive potentials from the pixel drive potential generating sections $GP_1$ through $GP_{(n/6)}$. Therefore, each pixel drive potentials for one scan line are simultaneously applied to the source lines ($R_1$ through $R_{n/3}$, $G_1$ through $G_{m/3}$, $B_1$ through $B_{n/3}$) of the display panel 20. Therefore, in order to suppress the instantaneously flowing large current, the source driver according to the second exemplary embodiment can make the charge amounts of charging each pixels by applying the respective pixel drive potentials for one scan line to uniform, even when timings of reading the pixel data at the second latch groups $608_1$ through $608_{(n/6)}$ are forcibly made to differ from each other as described above. Namely, the source driver according to the second exemplary embodiment can suppress the occurrence of EMI without deteriorating an image quality.

Note that, in the first and second exemplary embodiments as mentioned above, the first latch groups ($606_1$ through $606_{(n/6)}$) are configured to successively reads 6 pieces of the pixel data PD of the respective pixels, based on the inputted image signal. However, in the first latch group, a number of the pixel data PD pieces that are simultaneously read are not limited to 6 pieces.

For example, when K pieces (K is an integer equal to or larger than 2) of the pixel data PD of 8 bits are read in the first latch group at a time, the shift register 607 having the first latch group $606_1$ through $606_{(n/K)}$, and (n/K) stages of flip flops $FF_1$ through $FF_{(n/K)}$ may be adopted. Note that, each of the first latch groups $606_1$ through $606_{(n/K)}$ comprises K pieces of 8 bit latches. Further, the (n/K) stages of flip flops $FF_1$ through $FF_{(n/K)}$ shift the START signal to later stages in accordance with the clock signals CLK1. Output signals form the flip flops $FF_1$ through $FF_{(n/K)}$ are respectively supplied to the first latch groups $606_1$ through $606_{(n/K)}$ as the first load signals $L1_1$ through $L1_{(n/K)}$. Further, when such a configuration is adopted, the drive control section 10 supplies each pixel data PD in correspondence with each pixel on one scan line which are divided into K pieces of pixel data series, to the first latch groups $606_1$ through $606_{(n/K)}$.

Further, in the first and second exemplary embodiments as mentioned above, when the pixel data PD for one scan line is supplied from the first latch groups ($606_1$ through $606_{(n/6)}$) to the second latch groups ($608_1$ through $608_{(n/6)}$), every 6 pieces of the pixel data PD are read in series with the delay of the predetermined time period (DL). However, the number of pieces is not limited to 6 pieces. Every Q pieces (Q is an integer equal to or larger than 2) of the pixel data PD are read in series at the second latch groups ($608_1$ through $608_{(n/6)}$) with the delay of the predetermined time period (DL).

Further, in the first and second exemplary embodiments as mentioned above, the output gate sections $801_1$ through $801_{(n/6)}$ are provided in order to make even output timings when the pixel drive potentials outputted from the pixel drive potential generating section $GP_1$ through $GP_{(n/6)}$ are applied to the display pulse 20. However, in place of providing the output gate sections $801_1$ through $801_{(n/6)}$, the function of the output gate sections 801 may be provided to the switches $102_1$ through $102_3$, or the switches $101_1$ through $101_3$ shown in FIG. 4. For example, a configuration may be adopted in which the output switch signal SWOFF is supplied together with the polarity inversion signal POL to the switches $102_1$ through $102_3$ (switches $101_1$ through $101_3$). In this case, the switches $102_1$ through $102_3$ (switches $101_1$ through $101_3$) shall be adopted with a switch that outputs when in an open state, during a time period when the output switch signal SWOFF is at logical level of 1, as shown in FIG. 2 or FIG. 8.

Following from the above description, it should be apparent to those of ordinary skill in the art that, while the methods and apparatuses herein described constitute exemplary embodiments of the present disclosure and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the disclosure in order to fall within the scope of any claims, since the invention is defined by the claims and since inherent and/or unforeseen advantages of the present invention may exist even though they may not have been explicitly discussed herein.

What is claimed is:

1. A display panel driving apparatus for driving, a display panel including a plurality of display cells, each including pixels, in accordance with an inputted image signal, the display panel driving apparatus comprising:

as first latch section comprising a plurality of first latch groups that each include a plurality of first latches, the plurality of first latch groups configured to successively read and hold a pixel data piece for each pixel based on the inputted image signal;

a second latch section comprising a plurality of second latch groups that each include a plurality of second latches, the plurality of second latch groups configured to successively read and output pixel data pieces every Q pieces with a predetermined time difference therebetween in accordance with a load signal, where Q is an integer equal to or larger than 2;

a time difference adding section supplying signals to the plurality of second latch groups to shift a timing that each of the plurality of second latch groups successively reads and outputs pixel data pieces;

a drive potential generating section that generates a drive potential to drive each of the display cells based on the outputted pixel data pieces;

an output gate section that applies the drive potentials to the respective display cells of the display panel, simultaneously after an elapse of a predetermined tune period from a timing of supplying the load signal; and a timer supplying an output switch signal to the output gate section to turn off switches of the output gate section to bring source lines of the display panel into a high impedance state, wherein the timer is configured to receive the load signal and generates the output switch signal responsive to the load signal.

2. The display panel driving apparatus according to claim 1, wherein the first latch section reads and holds pixel data pieces corresponding to respective scan lines of the display panel, and the second latch section successively reads and outputs the pixel data pieces for one scan line every Q pieces, with the predetermined time difference therebetween.

3. The display pane driving apparatus according to claim 2, wherein the predetermined time period is longer than a time period taken from the supplying of the load signal to read all of the pixel data pieces for one scan line at the second latch section.

4. A display panel driving apparatus of claim 1, further comprising an output delay control section that includes the timer and is configured to signal the output gate section to turn off switches of the output gate section to bring source lines of the display panel into the high impedance state.

5. A display panel driving apparatus of claim 4, wherein the output delay control section is configured to receive the load signal and a signal from the time difference adding section, and generates the output switch signal responsive to the load signal and the signal from the time difference adding section.

6. A display panel driving apparatus for driving a display panel including a plurality of display cells, each including pixels, in accordance with an inputted image signal, the display panel driving apparatus comprising:

a first latch section comprising a plurality of first latch groups that each include a plurality of first latches, the plurality of first latch groups configured to successively read and hold a pixel piece data piece for each pixel based on the inputted image signal;

second latch section comprising a plurality of second latch groups that each include a plurality of second latches, the plurality of second latch groups configured to successively read output pixel data pieces every Q pieces with a predetermined time, difference therebetween in accordance with a load signal, where Q is an integer equal to or larger than 2;

a time difference adding section supplying timing signals to the plurality of second latch groups to shift a timing that each of the plurality of second latch groups successively reads and outputs pixel data pieces, wherein the timing signals are responsive to the load signal:

a drive potential generating section that generates a drive potential to drive each of the display cells based on the outputted pixel data pieces;

an output gate section that applies the drive potentials to the respective display cells of the display panel, simultaneously after an elapse of a predetermined time period from a timing of supplying the load signal: and, a timer supplying an output switch signal to the output gate section to turn off switches of the output gate section to bring source lines of the display panel into a high impedance state, wherein the timer is configured to receive the load signal and generates the output switch signal responsive to the load signal.

7. The display panel driving apparatus to claim 6, wherein the first latch section reads and holds pixel data pieces corresponding to respective scan lines of the display panel, and the second latch section successively reads and outputs the pixel data pieces for one scan line every Q pieces, with the predetermined time difference therebetween.

8. The display panel driving apparatus according to claim 7, wherein the predetermined time period is longer than a tune period taken from the supplying of the load signal to read all of the pixel data pieces for one scan line at the second latch section.

9. A display panel driving apparatus of claim 6, further comprising an output delay control section that includes the and is configured to signal the output gate section to turn off switches a the output gate section to bring source lines of the display panel into the high impedance state.

10. A display panel driving apparatus of claim 9, wherein the output delay control section is configured to receive the load signal and a signal from the time difference adding section, and generates the output switch signal responsive to the load signal and the signal from the time difference adding section.

* * * * *